US008905159B2

(12) United States Patent
Downton

(10) Patent No.: US 8,905,159 B2
(45) Date of Patent: Dec. 9, 2014

(54) ECCENTRIC STEERING DEVICE AND METHODS OF DIRECTIONAL DRILLING

(75) Inventor: Geoffrey C. Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 602 days.

(21) Appl. No.: 12/638,017

(22) Filed: Dec. 15, 2009

(65) Prior Publication Data

US 2011/0139513 A1 Jun. 16, 2011

(51) Int. Cl.
*E21B 7/08* (2006.01)
*E21B 7/06* (2006.01)

(52) U.S. Cl.
CPC ..... *E21B 7/067* (2013.01)
USPC ..... 175/61; 175/74

(58) Field of Classification Search
USPC ..... 175/73, 74, 61
See application file for complete search history.

(56) References Cited

U.S. PATENT DOCUMENTS

| | | | | |
|---|---|---|---|---|
| 3,807,502 | A | 4/1974 | Heilhecker et al. | |
| 3,957,118 | A | 5/1976 | Barry et al. | |
| 3,967,680 | A * | 7/1976 | Jeter | 175/38 |
| 4,126,848 | A | 11/1978 | Denison | |
| 4,806,928 | A | 2/1989 | Veneruso | |
| 4,901,069 | A | 2/1990 | Veneruso | |
| 4,995,466 | A * | 2/1991 | Snow, Jr. | 175/61 |
| 5,052,941 | A | 10/1991 | Hernandez-Marti et al. | |
| 5,113,953 | A | 5/1992 | Noble | |
| 5,265,682 | A | 11/1993 | Russell et al. | |
| 5,278,550 | A | 1/1994 | Rhein-Knudsen et al. | |
| 5,421,421 | A * | 6/1995 | Appleton | 175/76 |
| 5,520,255 | A | 5/1996 | Barr et al. | |
| 5,531,592 | A | 7/1996 | Tasi | |
| 5,553,678 | A | 9/1996 | Barr et al. | |
| 5,553,679 | A | 9/1996 | Thorp | |
| 5,582,259 | A | 12/1996 | Barr | |
| 5,603,385 | A | 2/1997 | Colebrook | |
| 5,673,763 | A | 10/1997 | Thorp | |
| 5,685,379 | A | 11/1997 | Barr et al. | |
| 5,695,015 | A | 12/1997 | Barr et al. | |
| 5,706,905 | A | 1/1998 | Barr | |
| 5,778,992 | A | 7/1998 | Fuller | |
| 5,803,185 | A | 9/1998 | Barr et al. | |
| 5,971,072 | A | 10/1999 | Huber | |
| 5,971,085 | A | 10/1999 | Colebrook | |
| 6,089,332 | A | 7/2000 | Barr et al. | |
| 6,092,610 | A | 7/2000 | Kosmala et al. | |
| 6,109,370 | A * | 8/2000 | Gray | 175/61 |
| 6,158,529 | A | 12/2000 | Dorel | |

(Continued)

OTHER PUBLICATIONS

Drillstring. (n). Schlumberger Oilfield Glossary. Retrieved Jun. 13, 2013, from Slb.com website: http://www.glossary.oilfield.slb.com/en/Terms/d/drillstring.aspx?p=1.*

*Primary Examiner* — Robert E Fuller
(74) *Attorney, Agent, or Firm* — Chadwick A. Sullivan; Wesley Noah

(57) ABSTRACT

A method, system and apparatus for steering a drill string employ, an eccentric steering device. The eccentric steering device may comprise an eccentric sleeve configured for mounting exterior to a portion of the drill string and permitting the drill string to rotate within the eccentric sleeve and a brake positioned to selectively cause rotation of the eccentric sleeve with the drill string. The eccentric steering device may further comprise one or more bearings positioned between the eccentric sleeve and the drill string.

16 Claims, 6 Drawing Sheets

(56) References Cited

U.S. PATENT DOCUMENTS

| | | | | |
|---|---|---|---|---|
| 6,234,259 | B1 * | 5/2001 | Kuckes et al. | 175/73 |
| 6,244,361 | B1 | 6/2001 | Comeau | |
| 6,290,003 | B1 * | 9/2001 | Russell | 175/73 |
| 6,364,034 | B1 | 4/2002 | Schoeffler | |
| 6,394,193 | B1 | 5/2002 | Askew | |
| 6,641,434 | B2 | 11/2003 | Boyle et al. | |
| 6,892,830 | B2 * | 5/2005 | Noe et al. | 175/61 |
| 6,913,095 | B2 * | 7/2005 | Krueger | 175/76 |
| 7,234,544 | B2 * | 6/2007 | Kent | 175/74 |
| 2001/0052428 | A1 | 12/2001 | Larronde et al. | |
| 2002/0011359 | A1 | 1/2002 | Webb et al. | |
| 2006/0131030 | A1 | 6/2006 | Sheffield | |
| 2007/0154341 | A1 | 7/2007 | Saenger | |
| 2009/0308659 | A1 * | 12/2009 | Crowley et al. | 175/61 |

* cited by examiner

ECCENTRIC STEERING DEVICE AND METHODS OF DIRECTIONAL DRILLING

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under an environmentally-sensitive area, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

SUMMARY OF THE INVENTION

The present invention recites an eccentric steering device for steering a drill string, the eccentric steering device comprising an eccentric sleeve configured for mounting exterior to a portion of the drill string and permitting the drill string to rotate within the eccentric sleeve and a brake positioned to selectively cause rotation of the eccentric sleeve with the drill string. In accordance with aspects of the present invention, the eccentric steering may further comprise one or more bearings positioned between the eccentric sleeve and the drill string. Additionally, the aforementioned bearings may be mounted on an exterior surface of the drill string or alternatively wherein the bearings may be mounted on an interior surface of the eccentric sleeve.

Additionally, the brake may be mounted on the drill string or alternatively may be mounted on the eccentric sleeve. Furthermore, in accordance with aspects of the present invention the eccentric sleeve may include one or more ribs for engaging with a borehole wall.

Furthermore, in accordance with one embodiment of the present invention, the aforementioned one or more ribs may be configured for extension when the brake is not actuated.

In accordance with the present invention, the eccentric steering device may further comprise an actuator configured to control the brake. The actuator may be a valve, and may be utilized in the control flow of drilling fluid to the brake. Additionally, the present invention recites a control device configured to control the actuator. The control device may include one or more sensors selected from the group consisting of: a rotational speed sensor, an accelerometer, and a three-dimensional accelerometer. Additionally, the control device may include a magnetometer configured to detect the position of the eccentric sleeve.

In accordance with an alternative embodiment of the present invention a wellsite system comprising a drill string including an eccentric steering device comprising an eccentric sleeve configured for mounting exterior to a portion of the drill string and permitting the drill string to rotate within the eccentric sleeve and a brake positioned to selectively cause or impair rotation of the eccentric sleeve with the drill string about the drill string collar and a kelly coupled to the drill string is recited. The eccentric steering device of the wellsite system may further comprises one or more bearings positioned between the eccentric sleeve and the drill string. Additionally, the eccentric sleeve may include one or more ribs. In one embodiment, the one or more ribs are configured for extension when the brake is not actuated.

In one embodiment, the eccentric steering device of the aforementioned wellsite system may further comprise an actuator configured to control the brake and a control device configured to control the actuator.

The present invention further recites a method for directional drilling, the method comprising the steps of providing a drill string including an eccentric steering device comprising an eccentric sleeve configured for mounting exterior to a portion of the drill string and permitting the drill string to rotate within the eccentric sleeve and a brake positioned to selectively cause rotation of the eccentric sleeve with the drill string, rotating the drill string and selectively actuating the brake to cause the eccentric sleeve to rotate with the drill string until a desired position is reached and finally releasing the brake at the desired position such that a curved borehole is drilled.

The aforementioned method may further comprise the step of detecting a position of the eccentric sleeve with respect to the drill string.

In accordance with an alternative embodiment of the present invention, an eccentric steering device for steering a drill string is recited, wherein the eccentric steering device comprises a sleeve configured for mounting exterior to a portion of the drill string and permitting the drill string to rotate within the sleeve and a piston adapted for extension from the sleeve to apply a lateral force to the drill string. In one embodiment, the sleeve has a substantially circular cross section. Additionally, the piston may be actuated for extension by pressure within the sleeve. Furthermore, the aforementioned eccentric steering device may include a valve adapted to regulate pressure within the sleeve. Furthermore, the piston may include a weep hole adapted to relieve pressure within the sleeve. Additionally, a spring adapted to hold the piston in a retracted position in the absence of pressure may be provided in accordance with one embodiment. In accordance with this embodiment, the piston may contacts the drill string when held in the retracted position. Alternatively, the piston may interface with the drill string to transmit rotational force to the sleeve. Said interface may be formed by friction between the piston and the drill string. In one embodiment said interface may be formed by interaction between one or more notches on the piston and one more detents on the drill string.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

Aspects of the invention provide gauge pads, cutters, rotary components, and methods for directional drilling.

Some embodiments of the invention provide efficient devices and techniques that utilize drill string rotation to redirect an eccentric steering force to achieve real-time control of tool-face (the direction in which the bit is offset in the borehole). Unlike conventional systems that utilize multiple ribs to produce an eccentric force, by utilizing the rotation of the drill string, embodiments of the present systems can position a single eccentric steering device in any desired location to control tool-face. Various embodiments of the invention can be used in wellsite systems.

Wellsite System

Figure 1:
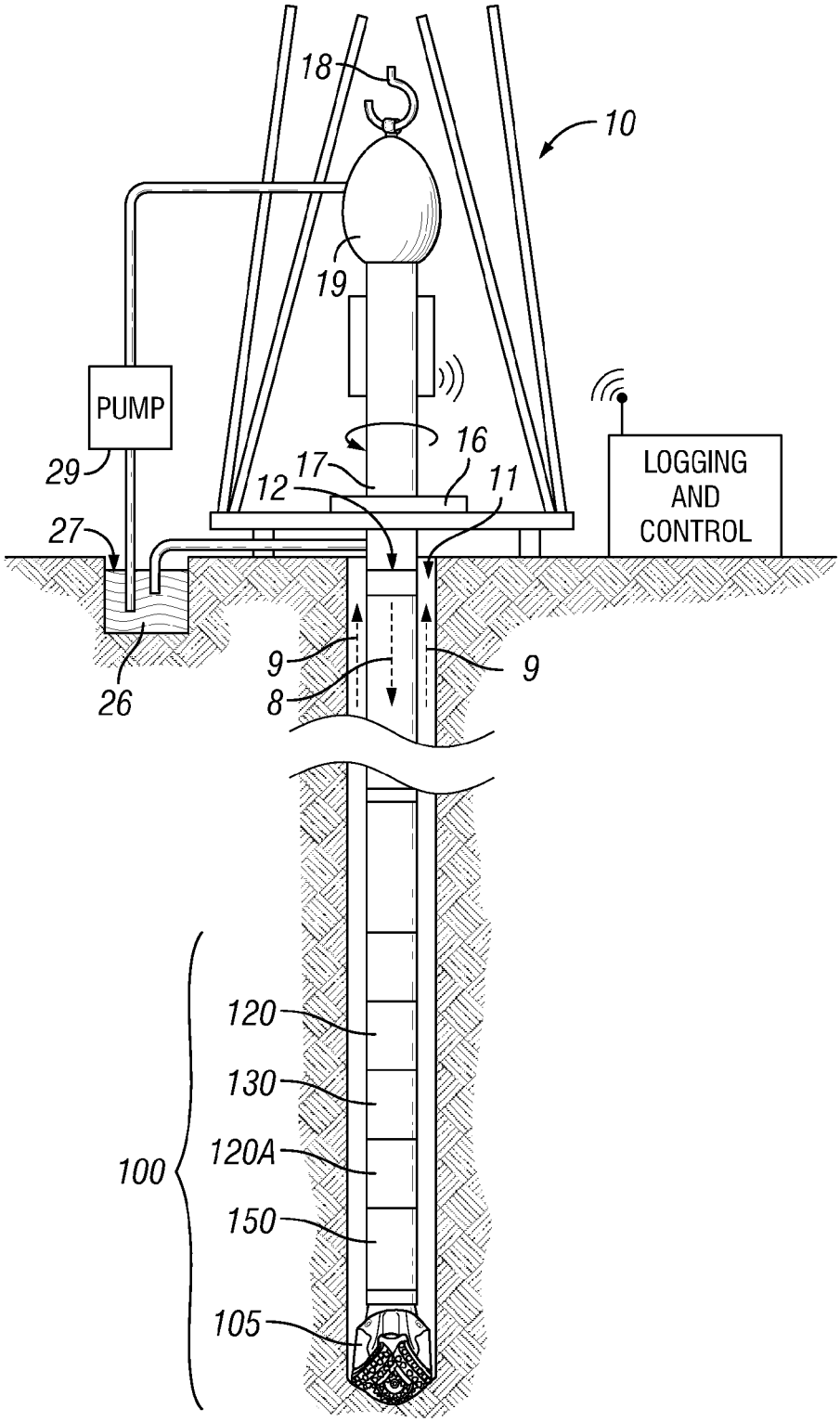
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed and positioned in tools other than MWD module 130 and/or alone as a separate power component. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device, although not all devices will be required for each embodiment.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface and/or by a downhole motor, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form, the drill bit is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Eccentric Steering Devices

Figure 2A:
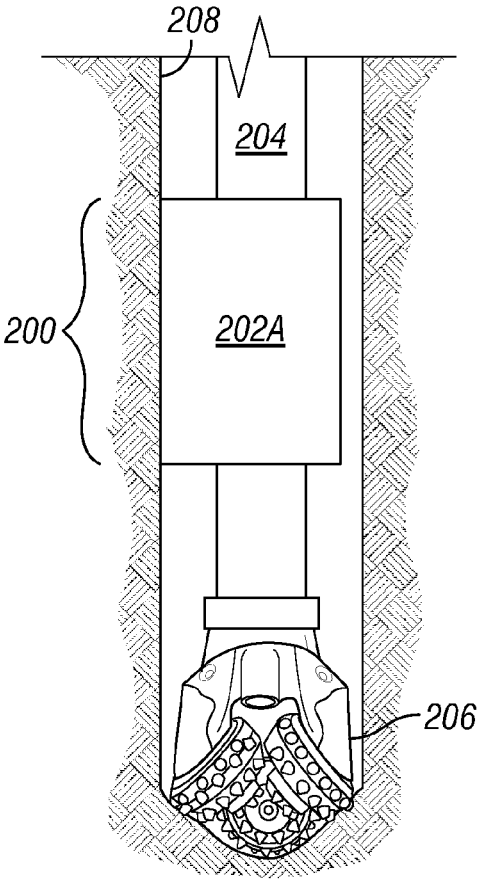
FIGS. 2A and 2B depict eccentric steering devices according to embodiments of the invention.
Figure 2B:
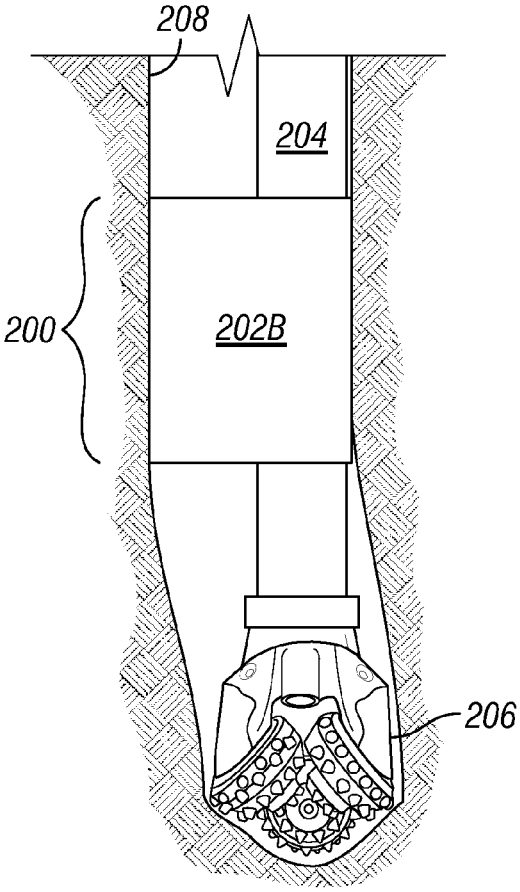

Referring now to FIG. 2, an eccentric steering device 200 according to one embodiment of the invention is depicted. Eccentric steering device 200 includes an eccentric sleeve 202 that can be mounted on a portion of a drill string 204 (e.g., near drill bit 206) such that drill string 204 rotates within the eccentric steering sleeve 202. In some embodiments such as those depicted in FIG. 2A, the external diameter of the eccentric sleeve 202*a* is less than or substantially equal to the gauge of the drill bit 206. In other embodiments such as those depicted in FIG. 2B, the radial distance from the center line of the drill string 204*b* to the extreme lobe of the eccentric sleeve 202 is greater than the gauge of the drill bit 206. A brake (not depicted) within eccentric steering device 200 can be selectively actuated, which causes the eccentric sleeve 202 to rotate with the drill string 204. As the eccentric sleeve 202 attempts to rotate with the drill string 204, the eccentric sleeve engages with the borehole wall 208, thereby causing the drill string 204 and/or drill bit to be pushed off axis. When the desired location is reached, the brake is released and the drill string 204 resumes rotation within the eccentric sleeve 202.

Figure 3A:
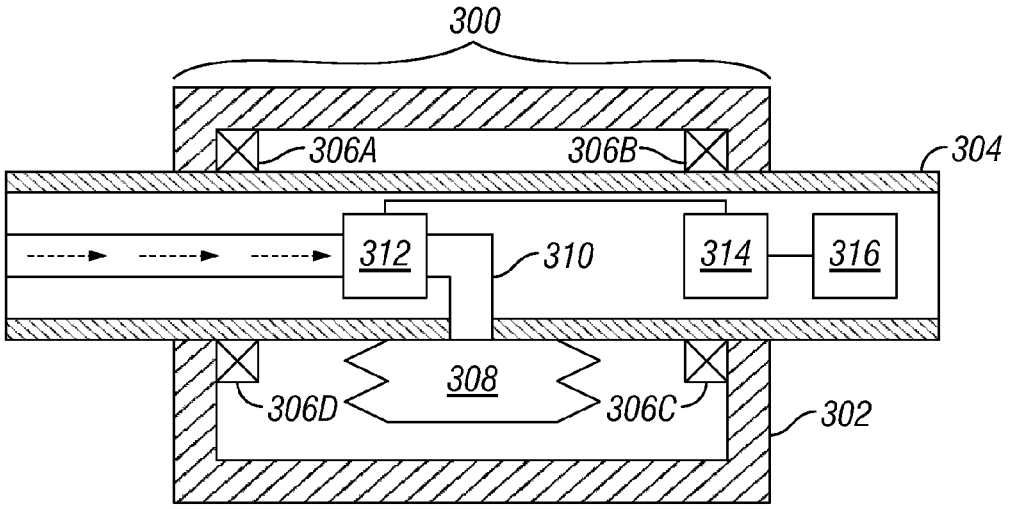
FIGS. 3A and 3B depict a longitudinal cross section of an eccentric steering according to an embodiment of the invention.
Figure 3B:
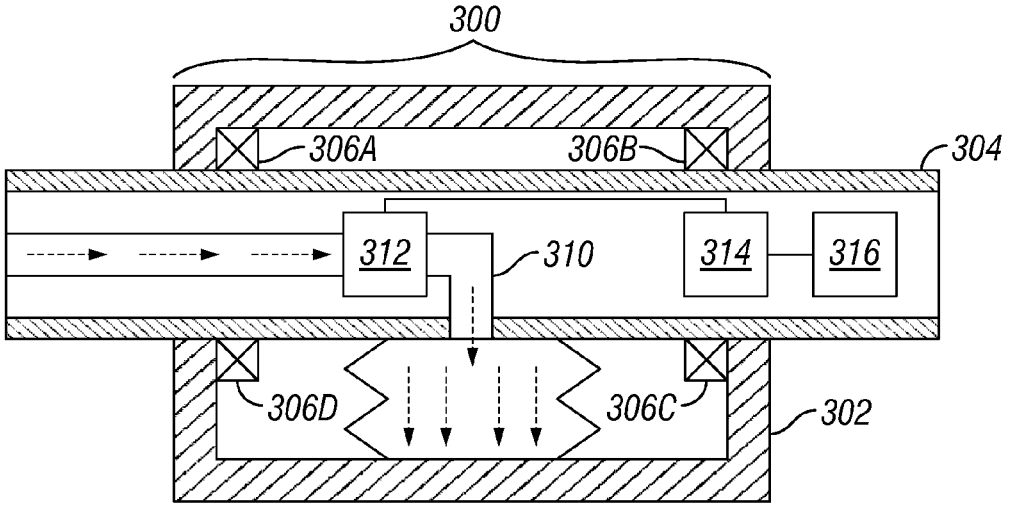

Referring now to FIGS. 3A and 3B, a longitudinal cross section of an eccentric steering 300 according to an embodiment of the invention is depicted. Eccentric sleeve 302 can be retained on drill string 304 by one or more bearings 306 or other complimentary geometric features on eccentric sleeve 302 and/or drill string 304.

Brake 308 can be any device capable of inhibiting the rotation (or lack thereof) of eccentric sleeve 302 with respect to drill string 304. In some embodiments, brake 308 is a friction brake in which a pad is applied to the eccentric sleeve. In other embodiments, a mechanical linkage (e.g., a rod) selectively couples the eccentric sleeve 302 and drill string 304. In still another embodiment, an electromagnet can be selectively actuated to link the rotation of eccentric sleeve 302 and drill string 304. Although brake 308 in FIGS. 3A and 3B extends from the drill string 304 to the eccentric sleeve 302, brake 308 can, in some embodiments, extend from the eccentric sleeve 302 to the drill string 304. In some embodiments, brake 308 is powered by fluid from conduit 310.

In FIG. 3A, brake 308 is not actuated and drill string 304 can rotate freely within the eccentric sleeve 302. In FIG. 3B, brake 308 is actuated by fluid from conduit 310 and eccentric sleeve 302 is engaged by the rotating drill string 304.

Eccentric steering device 300 can include an actuator 312 configured to control operation of brake 308. In embodiments with hydraulic or pneumatic brakes 308, actuator 312 can be a valve. In embodiments with motor-driven brakes 308, actuator 312 can be a switch.

Actuator 312 can be in communication with a control device 314. Control device 314 controls the operation of actuator 312 to steer drill string 302 and maintain the proper angular position of the bottom hole assembly relative to the subsurface formation. In some embodiments, the control device 314 is mounted on a bearing that allows the control device 314 to rotate freely about the axis of the bottom hole assembly. In other embodiments, control device 314 is mounted within sleeve 302.

The control device 314, according to some embodiments, contains sensory equipment 316 such as direction and inclination (D&I) sensors, rotational speed sensor, accelerometers (e.g., three-axis accelerometers), orientation sensors, and/or magnetometer sensors to detect the inclination and azimuth of the bottom hole assembly. Control device 314 can also communicate with an angle sensor, which can, in some embodiments, include a magnetometer in the drill string and a magnet in the sleeve (not depicted), to determine the orientation of eccentric sleeve 302 with respect to drill string 304.

In some embodiments, the sensory equipment 316 includes a dual axis magnetometer package that measures the sine and cosine components of the local earth's magnetic field. With this information and knowledge of the local magnetic field, the control device 314 can calculate an orientation with respect to the local vertical.

There are several embodiments of dual axis magnetometers capable calculating the angular orientation of the eccentricity of sleeve 302. In one embodiment, a dual axis magnetometer is provided in sleeve 302 along with a device (e.g., wired or wireless) for communicating with controller 314. In another embodiment, a dual axis magnetometer 314 is provided in drill string 304 and an angle sensor in the drill string 304 calculates the relative orientation of sleeve 302. In still another embodiment, a first dual axis magnetometer is provided within the sleeve 304 and a second dual axis magnetometer is provided in the drill string 302 along with a communication device (e.g., wired or wireless).

The control device 314 can further communicate with sensors disposed within elements of the bottom hole assembly such that said sensors can provide formation characteristics or drilling dynamics data to control unit. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bottom hole assembly.

In some embodiments, control device 314 is programmed above ground to follow a desired inclination and direction. The progress of the bottom hole assembly can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWERPULSE™ trademark from Schlumberger Technology Corporation of Sugar Land, Tex. In other embodiments, wired drill pipe can be used for communication with control device 314.

In another embodiment, control device 314 is positioned above ground and actuates valve 312 via wired drill pipe as described in U.S. Pat. Nos. 3,807,502; 3,957,118; 4,126,848; 4,806,928; 4,901,069; 5,052,941; 5,278,550; 5,531,592; 5,971,072; and 6,641,434.

Figure 4:
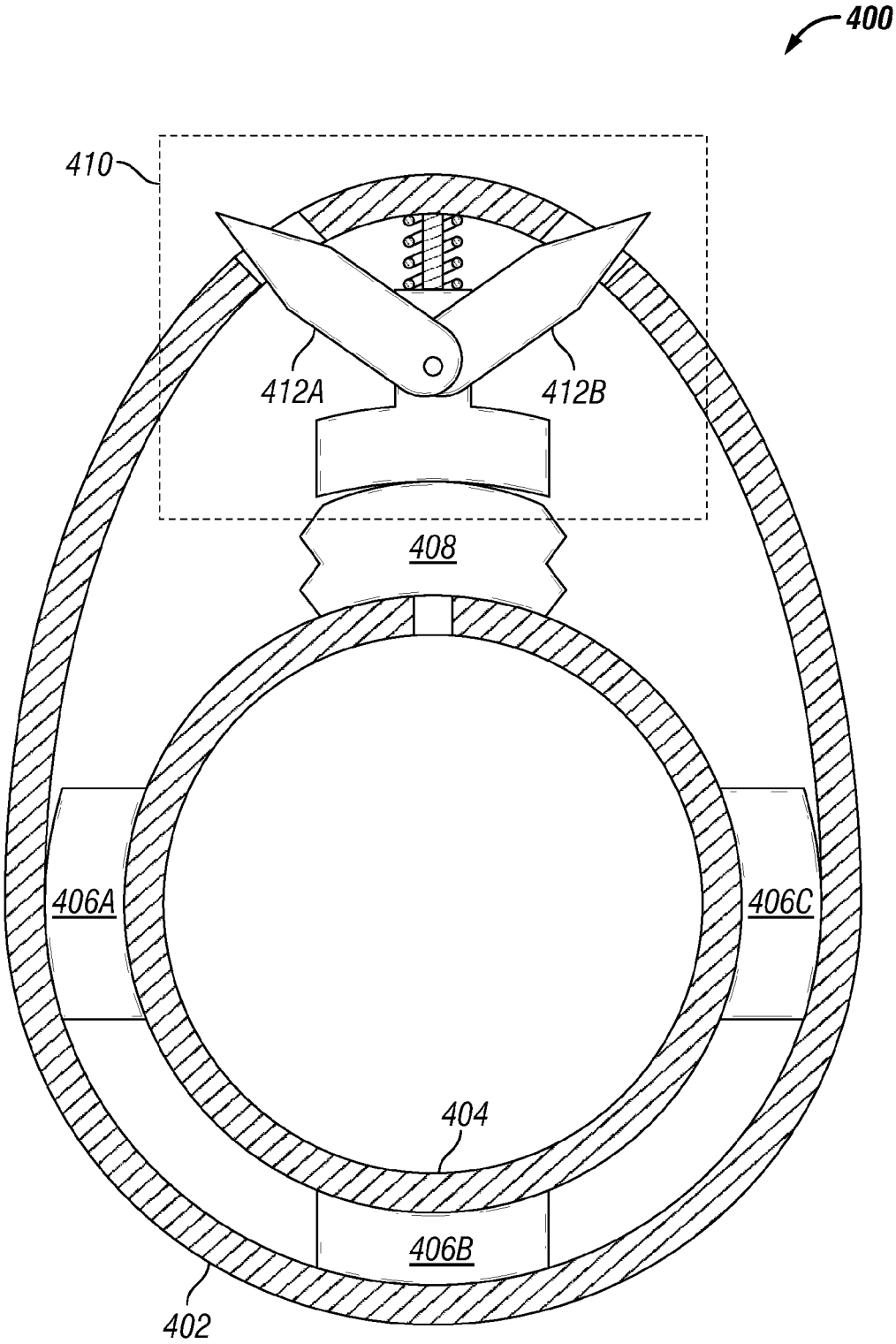
FIG. 4 depicts a latitudinal cross section of an eccentric steering device according to an embodiment of the invention.

Referring now to FIG. 4, a latitudinal cross section of an eccentric steering device 400 is depicted. Drill string 404 rotates with eccentric sleeve 402 and can be retained by bearings 406. When brake 408 is actuated, brake 408 both retains the eccentric sleeve 402 and actuates a device 410 within the eccentric sleeve 402 to deploy one or more spikes, ribs, and the like 412 beyond the profile of eccentric sleeve 402 to better grip the borehole wall. Spikes 412 can be spring-loaded to retract when the brake 406 is released. Alternatively, spikes 412 can be spring-loaded to deploy and grip the borehole wall when the brake is not actuated and to retract when the brake is actuated.

Figure 5A:
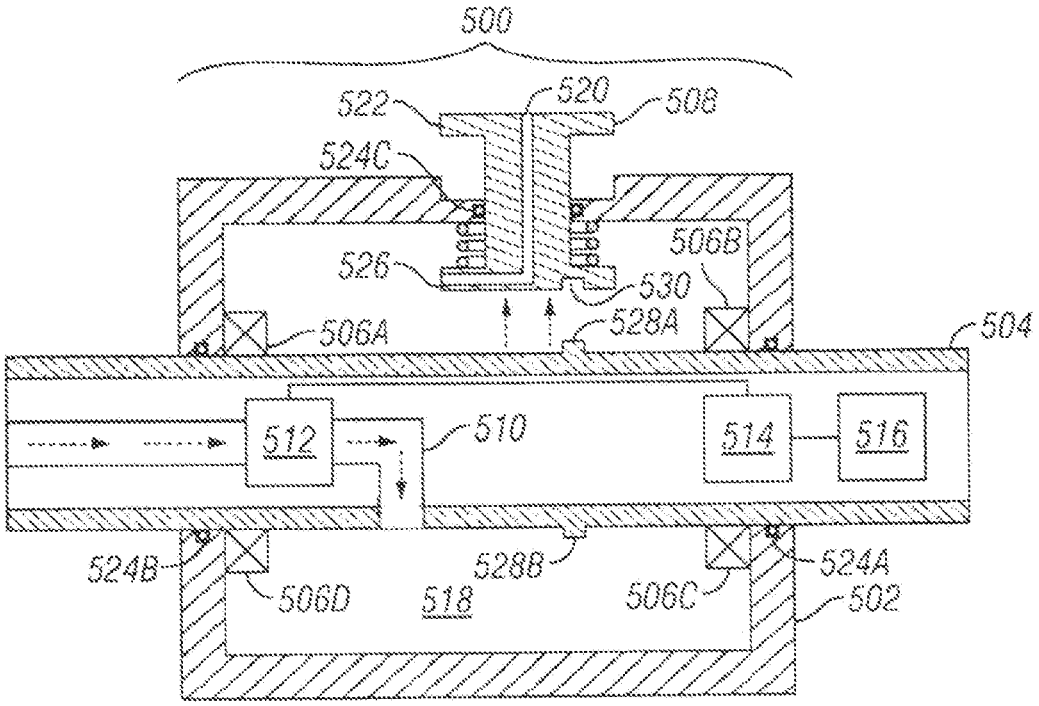
FIGS. 5A and 5B depict longitudinal cross sections of a piston-based eccentric steering device according to an embodiment of the invention.

Referring now to FIG. 5A, a longitudinal cross section of a piston-based eccentric steering device 500 is provided. Sleeve 502 can be mounted on a portion of a drill string 504 (e.g., supported by bearings 506). Sleeve 502 can have a substantially circular cross section or alternatively can be eccentric. To actuate piston 508, valve 512 allows fluid to flow through conduit 510 into an internal cavity 518 between sleeve 502 and drill string 504. Fluid pressure within cavity 518 causes piston 508 to extend laterally outward and contact borehole wall to apply a steering force. Weep hole 520 allows fluid pressure to drain from cavity 518 when valve 512 is closed, thereby allowing the omission of a pressure relief valve in some embodiments. Additionally or alternatively, fluid can be allowed to seep from between sleeve 502 and drill string 504 to lubricate bearings 506. Additionally or alternatively, cavity 518 can be sealed by seals 524 such as O-rings and the like. Valve 512 can be actuated by control device 514 in communication with sensory equipment 516 as discussed herein.

Figure 5B:
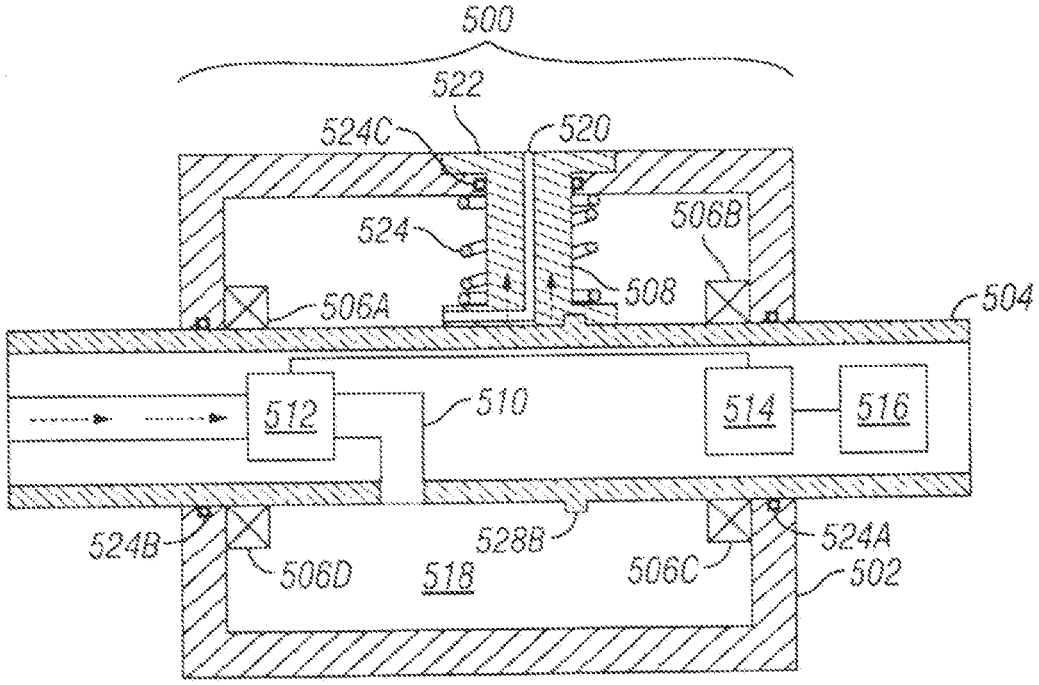

Referring now to FIG. 5B, when valve 512 suspends fluid flow to cavity 518, spring 524 causes piston 508 to return to a retracted position. The retracted position is the default position, and the steering device 500 will revert to this position if communication to valve 512 is terminated for any reason. In some embodiments, piston 508 sits substantially flush with the external diameter sleeve 302 when retracted. In this position, the underside 526 of piston 508 engages with drill string 504 and rotates with drill string 504 to a new orientation when the piston 508 is redeployed by actuation of valve 512. In some embodiments, underside 526 engages with drill string 504 through friction between the underside 504 and drill string, as augmented by spring 524. In other embodiments, one or more detents 528 on drill string 504 interface with one or more notches 530 on underside 526.

Method of Directional Drilling

Figure 6:
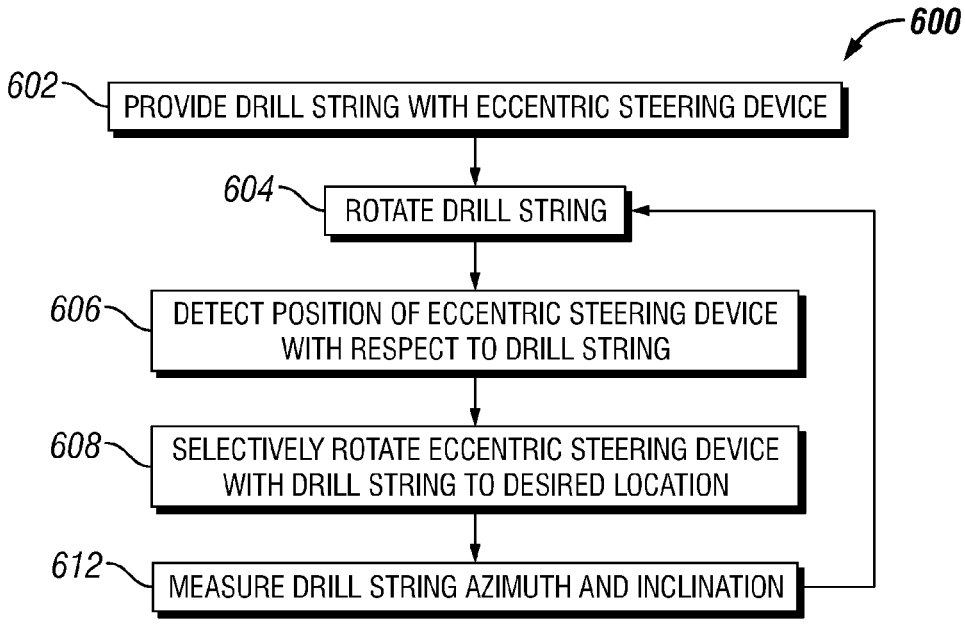
FIG. 6 depicts a method of directional drilling according to one embodiment of the invention.

Referring now to FIG. 6, a method of directional drilling 600 is provided. In step S602, a drill string is provided with an eccentric steering device, for example, eccentric steering devices as provided herein. In step S604, the drill string is rotated. In step S606, the position of the eccentric steering device with respect to the drill string is detected. In step S608, the eccentric steering device is selectively rotated with the drill string to desired location. Rotation of the eccentric steering device can be effected in a variety of ways to reflect the various architectures described herein. For example, eccentric steering device 300 depicted in FIGS. 3A and 3B can be rotated by actuating valve 312 permit fluid flow to deploy brake 308 until the desired location is reached. In contrast, eccentric steering device 500 can be rotated by actuating valve 512 to suspend fluid flow, thereby causing the underside 526 of piston 508 to engage with drill string 504 until the desired location is reached. In step S610, the azimuth and inclination of the drill string are measured. Based on this reading, and the position of the sleeve determined in step S606, the sleeve can be rotated to achieve the desired tool face.

Selective rotation of the eccentric steering device in step S608 can be calibrated to reflect the rotational speed of the drill string as well and any transmission or implementation delays for actuation.

Figure 7:
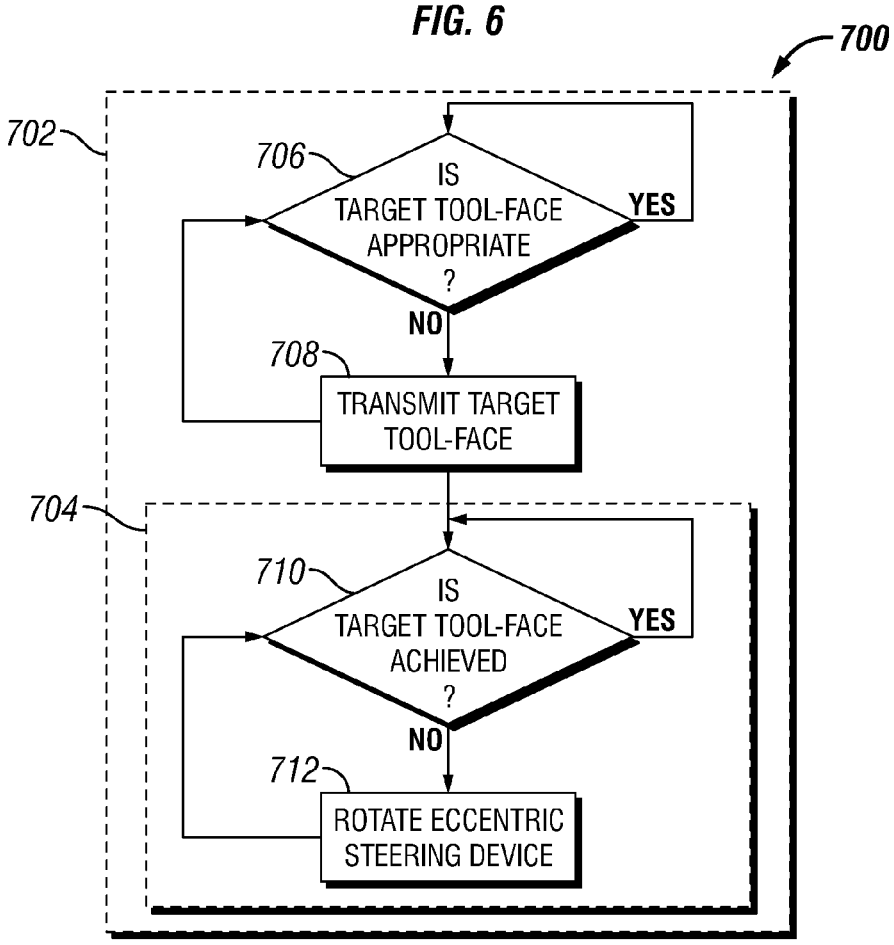
FIG. 7 depicts a method of directional drilling by controlling a tool-face (TF).

Referring now to FIG. 7, a method 700 of directional drilling by controlling a tool-face (TF) is provided. In some embodiments, the method 700 is implemented as a nested loop in which target tool-face is set by an outer loop 702 and the target tool-face is implemented by an inner loop 704. In step S706, the adequacy of a target tool-face is analyzed. For example, the target tool-face can be adjusted to reflect a well plan. Such a well plan can specify drilling parameter such as tool-face, azimuth, and the like at various positions that may be a function of the length of drill string fed into the ground. If the existing target tool-face is appropriate, the method 700 loops to step S706. If the existing target tool-face is not appropriate, a new target tool-face is transmitted in step S708. In step S710, the current tool-face and the target tool-face is compared to determine if the target tool-face is achieved. If the target tool-face is achieved, step S710 is repeated. If the target tool-face is not achieved, the eccentric steering device is rotated to a desired position in step S712.

For example, to achieve a desired TF of 0° so that the bit drills upwards in the "build" direction, the sleeve should be oriented such that the eccentricity is about 180° out of phase. In another example, to drill straight forward, the sleeve can be continuously dragged as the drill string rotates. In still another example, if the drill string is currently drilling in a desired direction with a TF of 15° right and the desired new direction requires a TF of 0° C., then the control device will position the sleeve 15° counter-clockwise to its current orientation when looking down the borehole.

One or more loops 702, 704 can be implemented by a human, hardware, software, or a combination of one of the above. Likewise, loops 702, 704 can be implemented above-ground, below-ground, or a combination of both. Preferably, inner loop 704 is implemented by a control device in proximity to the eccentric steering device as discussed herein so that the tool-face can be monitored and adjusted on a per rotation basis.

Incorporation By Reference

All patents, published patent applications, and other references disclosed herein are hereby expressly incorporated by reference in their entireties by reference.

Equivalents

Those skilled in the art will recognize, or be able to ascertain using no more than routine experimentation, many equivalents of the specific embodiments of the invention described herein. Such equivalents are intended to be encompassed by the following claims.

The invention claimed is:

1. An eccentric steering device for steering a drill string, the eccentric steering device comprising:

an eccentric sleeve being eccentric with respect to a center line of the drill string, the eccentric sleeve being mounted exterior to the drill string along a portion of the drill string and permitting the drill string to rotate within the eccentric sleeve, the drill string extending linearly through the eccentric sleeve and being rotatably coupled to the eccentric sleeve via a bearing disposed between the eccentric sleeve and the drill string to enable proper rotation of the drill string within the eccentric sleeve; and a brake actuated in a radial direction, the brake positioned to selectively cause rotation of the eccentric sleeve with the drill string, the brake being a friction brake which may be selectively released and actuated to create friction which inhibits rotation of the eccentric sleeve with respect to the drill string at desired rotational positions of the eccentric sleeve with respect to the drill string.

2. The eccentric steering device of claim 1, further comprising:

one or more bearings positioned between the eccentric sleeve and the drill string.

3. The eccentric steering device of claim 2, wherein the bearings are mounted on an exterior surface of the drill string.

4. The eccentric steering device of claim 2, wherein the bearings are mounted on an interior surface of the eccentric sleeve.

5. The eccentric steering device of claim 1, wherein the brake is mounted on the drill string.

6. The eccentric steering device of claim 1, wherein the brake is mounted on the eccentric sleeve.

7. The eccentric steering device of claim 1, further comprising:

an actuator configured to control the brake.

8. The eccentric steering device of claim 7, wherein the actuator is a valve.

9. The eccentric steering device of claim 8, wherein the valve controls flow of drilling fluid to the brake.

10. The eccentric steering device of claim 7, further comprising:

a control device configured to control the actuator.

11. The eccentric steering device of claim 7, wherein the control device includes one or more sensors selected from the group consisting of: a rotational speed sensor, an accelerometer, and a three-dimensional accelerometer.

12. The eccentric steering device of claim 7, wherein the control device includes a magnetometer configured to detect the position of the eccentric sleeve.

13. A wellsite system comprising:

a drill string including an eccentric steering device comprising:

an eccentric sleeve configured for mounting exterior to the drill string along a portion of the drill string and permitting the drill string to rotate within the eccentric sleeve during directional drilling, the drill string extending linearly through the eccentric sleeve;

a brake actuated in a radial direction, the brake positioned to selectively cause rotation of the eccentric sleeve with the drill string to a position in which the eccentric sleeve engages a borehole wall at an orientation which pushes the drill string off axis in a desired direction;

an actuator to control operation of the brake; and a control device mounted within the eccentric sleeve to control operation of the actuator; and a kelly coupled to the drill string.

14. The wellsite system of claim 13 wherein the eccentric steering device further comprises one or more bearings positioned between the eccentric sleeve and the drill string.

15. A method for directional drilling, the method comprising:

combining a drill string with an eccentric steering device comprising:

an eccentric sleeve configured for mounting exterior to the drill string along a portion of the drill string and permitting the drill string to extend through and rotate within the eccentric sleeve; and a brake positioned to selectively cause rotation of the eccentric sleeve with the drill string;

rotating the drill string about a center line of the drill string when drilling a borehole along an axis;

selectively actuating the brake in a radial direction to inhibit rotation of the eccentric sleeve relative to the drill string at any rotational position of the eccentric sleeve relative to the drill string and to thus cause the eccentric sleeve to rotate with the drill string until a desired position is reached;

releasing the brake at the desired position so the eccentric sleeve pushes against a borehole wall to push the drill string off the axis while the drill string remains extending through the eccentric sleeve along the center line; and thereby drilling a curved borehole.

16. The method of claim 15, further comprising:

detecting a position of the eccentric sleeve with respect to the drill string.

* * * * *